United States Patent [19]

Derichs

[11] 4,150,530

[45] Apr. 24, 1979

[54] METHOD AND DEVICE FOR CONTROLLING THE THREAD JOINING IN ROTOR SPINNING MACHINES

[75] Inventor: Josef Derichs, Mönchen-Gladbach, Fed. Rep. of Germany

[73] Assignee: W. Schlafhorst & Co., Mönchen-Gladbach, Fed. Rep. of Germany

[21] Appl. No.: 658,895

[22] Filed: Feb. 18, 1976

[30] Foreign Application Priority Data

Feb. 20, 1975 [DE] Fed. Rep. of Germany ..... 2507199

[51] Int. Cl.[2] ..... D01H 1/12

[52] U.S. Cl. ..... 57/263; 57/58.89; 57/264

[58] Field of Search ..... 57/58.89–58.95, 57/34 R, 156

[56] References Cited

U.S. PATENT DOCUMENTS

| | | | |
|---|---|---|---|
| 3,704,579 | 12/1972 | Tooka et al. | 57/58.89 X |
| 3,760,576 | 9/1973 | Le Chatelier et al. | 57/58.89 X |
| 3,789,595 | 2/1974 | Bernstein et al. | 57/34 R |
| 3,877,209 | 4/1975 | Seidl et al. | 57/58.89 X |
| 3,877,210 | 4/1975 | Seidl | 57/58.89 X |
| 3,878,671 | 4/1975 | Seidl et al. | 57/58.89 X |
| 3,943,689 | 3/1976 | Kunz et al. | 57/34 R |
| 3,987,610 | 10/1976 | Stablecker et al. | 57/34 R |
| 4,080,775 | 3/1978 | Stablecker et al. | 57/34 X |

*Primary Examiner*—Charles Gorenstein
*Attorney, Agent, or Firm*—Herbert L. Lerner

[57] ABSTRACT

Method of controlling thread joining in a rotor-spinning machine, which includes applying a pulse proportional to the rotary speed of the spinning machine rotor to control a measure of the material being processed in the spinning operation, and device for performing the foregoing method.

11 Claims, 2 Drawing Figures

FIG. 1
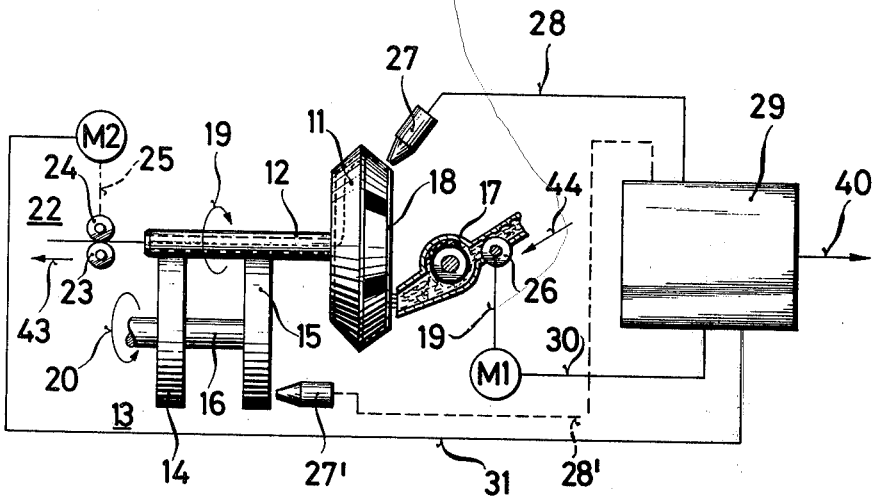
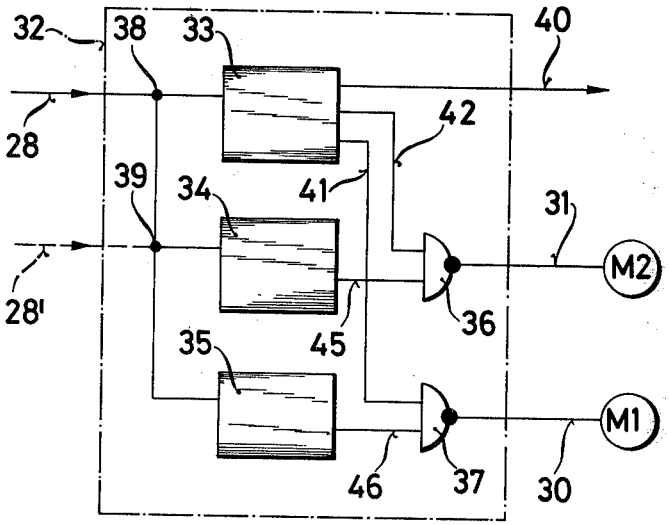
FIG. 2

METHOD AND DEVICE FOR CONTROLLING THE THREAD JOINING IN ROTOR SPINNING MACHINES

The invention relates to a method of controlling thread joining or attachment in rotor-spinning machines and a device for carrying out the method.

It has been known, heretofore, that the thread joining or attachment is capable of being performed manually in a given rotary speed range of the spinning rotor without any special difficulties. At high rotary speeds of the rotor, somewhat above 60,000 r.p.m., manual thread joining is virtually unable to be performed. It was therefore proposed heretofore, in this case, to carry out the thread joining operation during the initial acceleration or start-up operation of the rotor. A disadvantage is produced thereby, however, in that faulty thread junctions or attachments are formed because both the fiber feed into the rotor, as well as the thread or yarn withdrawal from the rotor cannot be readily accommodated to or matched with the continuously varying rotary speed of the rotor and, moreover, the rotary speed of the rotor at the instant of thread attachment is not readily determinable and capable of being signaled.

It is accordingly an object of the invention to provide a method and device for controlling the thread joining or attachment in rotor-spinning machines wherein the thread joining operation is automatized and thread attachments are produced which are as faultless as possible when the thread joining or attachment is carried out during initial acceleration or start-up operation of the rotor.

With the foregoing and other objects in view, there is provided, in accordance with the invention, a method of controlling thread joining in a rotor-spinning machine, which comprises applying a pulse proportional to the rotary speed of the spinning machine rotor to control a measure of the material being processed in the spinning operation, such as the fiber feed to the rotor and/or the thread or yarn withdrawal from the rotor. This could occur, for example, by using capacitive or inductive proximity switches of conventional construction, for example. In accordance with a further feature of the invention, the pulse formation is effected by means of photoelectronic components cooperating with suitable markings applied to at least one rotary part of the spinning machine. In order to obtain a high pulse frequency from the start, as large a number of markings as possible is advantageously provided.

In accordance with another feature of the invention, the pulses that are produced are used to control at least one control motor which initiates and/or controls the course of movement required for performing the thread joining or attachment operation.

In accordance with an additional feature of the invention, to process the pulses into control signals, digital connecting or combining members, counters and/or multipliers and/or reducers or scalers are employed. The well-known AND-gates and, as the case may be, also OR-gates with and without negation may serve especially as the digital connecting or combining members. Conventional preselector counters, which emit control signals in accordance with a selectably adjustable number of pulses to be counted, are advantageously employed as the counters in the invention of the instant application, the control signals introducing or influencing specific operations required for effecting the thread joining or attachment operation. Converters, i.e. increasers or reducers or scalers are used, in accordance with yet another feature of the invention, especially for increasing or reducing the pulse frequency for the purpose of controlling one or more step motors.

For performing the method of the invention, a device is provided in the rotor-spinning machine, which comprises pulse generating means for producing pulses with a frequency proportional to the rotary speed of the rotor of the spinning machine, and means actuable by the pulses for controlling the thread joining or attachment operation by influencing a measure relating to the material being spun in the spinning operation, such as the supply of the thread-joining thread, the instant of thread attachment, the fiber feed and the thread or yarn withdrawal.

In accordance with added features of the invention, the pulse generating means comprises a pulse transmitter connected to a rotating member of the spinning machine, such as the rotor per se or a part of the spinning machine revolving at a speed proportional to the rotary speed of the rotor, as well as a pulse receiver. In accordance with another feature of the invention, detection or reception of the pulse is contactless.

In accordance with a further feature of the invention, the pulse transmitter comprises at least one colored marking, and the pulse receiver comprises at least one photoelectronic component. The photoelectronic component can operate, for example, like a conventional type of reflex-photoelectric cell.

In order that a separate pulse receiver should not have to be provided at every spinning station of the rotor-spinning machine, in accordance with yet another feature of the invention, the pulse receiver is connected to a thread joining or attachment device that is displaceable relative to the spinning stations of the spinning machine. A carriage which travels past the spinning stations serves, for example, to carry the thread joining device.

In accordance with other features of the invention, there are provided control motor means for controlling fiber feed to the spinning machine, and a pulse processing device connecting the control motor means to the pulse transmitter of the pulse generating means. There are, furthermore, provided control motor means for controlling yarn or thread withdrawal from the spinning machine, the latter control motor means being connected by the same or a different pulse processing device to the pulse transmitter of the pulse generating means.

In accordance with an added feature of the invention, the pulse processing device comprises one or more counters and/or at least one digital connecting or combining member and/or one or more converters, such as an increaser or a reducer.

The advantages of the invention are especially realizable when step motors are employed as the control motor means. This is particularly expedient for the control of the fiber feed because, through this construction, when using a convertor, such as an increaser or a reducer, exact proportionality between the rotary speed of the rotor and the fiber feed is always attained. Also, step motors that are conventional in the trade can be installed with respect to the thread or yarn withdrawal operation.

Thus, the advantages of the invention of the instant application are especially apparent in the fact that the thread joining or attachment operation is automatized by relatively simple means independently of the operating rotary speed of the spinning rotor.

Other features which are considered as characteristic for the invention are set forth in the appended claims.

Although the invention is illustrated and described herein as embodied in method and device for controlling the thread joining in rotor spinning machines, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIG. 1 is a partly diagrammatic, schematic diagram of the system for controlling the thread joining or attachment in rotor spinning machines according to the invention; and FIG. 2 is a schematic diagram of the pulse processing device forming part of the system of FIG. 1.

Referring now to the drawing and first, particularly, to FIG. 1 thereof, there are shown a rotor 11 with a hollow rotor shaft 12 mounted on a support bearing 13 which form part of a spinning station of a rotor-spinning machine that is not further illustrated. The support bearing 13 is formed of support rollers 14 and 15 which are connected one to the other by a shaft 16. A fiber feeding device 17 is disposed at the forward side of the rotor 11 and includes a feeding wheel 26 which is connected by any suitable operative connection 19 of conventional construction to a control motor M1. The rotor 11 is provided with ring segment-shaped colored markings 18 disposed on the outer surface thereof at uniformly spaced intervals, only two of the markings 18 being visible in FIG. 1.

The rotor shaft 12 and the rotor 11 rotate in direction of the arrow 19, and the support rollers 14 and 15 of the support bearing 13 rotate in direction of the arrow 20. The withdrawal of spun thread or yarn 21 is effected through the hollow rotor shaft 12 with the aid of a yarn-withdrawal device 22 formed of rollers 23 and 24. The roller 24 is driven by a control motor M2 through a diagrammatically indicated operative connection 25 of any suitable conventional construction.

A conventional photo-electronic pulse receiver 27 is located at a slight spacing from the surface of the rotor 11 above the markings 18, and is connected through an electric conductor or line 28 to a pulse processing device 29. Connecting lines 30 and 31 to the control motors M1 and M2, respectively, moreover extend from the pulse processing device 29.

The colored markings can also be applied to one of the support rollers, such as the support roller 15, for example, instead of to the rotor 11. Then, the pulse receiver 27' must be located at a slight spacing from the markings on the support roller 15 and must be connected through an electric line 28' to the pulse processing device 29, as shown in FIG. 1.

One embodiment for the assembly of the components within the pulse processing device 29 is shown schematically in FIG. 2. A counter 33, two reducers or scalers 34 and 35 and two digital connecting members 36 and 37 are connected, as shown, within the confines 32 of the device 29. The electric line 28 extending from the pulse receiver 27 leads through the branching locations 38 and 39 to the counter 33 and to the reducers or scalers 34 and 35. The counter 33 in the circuit of FIG. 2 is a pulse counter which, after a number of input pulses separately selectable for each counter output, generates a separate output pulse for each output. The reducers 34 and 35 are generally classified as converters. In the circuit of FIG. 2, the reducers 34 and 35 are frequency converters which convert the pulses of given frequency into pulses of lower frequency.

The counter 33 has three output lines 40, 41 and 42. The output line 40 is left unconnected, the output line 41 leads to the digital connecting member 37, and the output line 42 to the digital connecting member 36. The control motor M1 is connected through the connecting line 30 to the output of the digital connecting member 37, and the control motor M2 through the connecting line 31 to the output of the digital connecting member 36.

The components 33, 34 and 35 thus all serve to control the varied rotary speeds of the motors M1 and M2 through one and the same input pulse. The converters and counters required therefor are well known and have many different constructions. For the purpose of this embodiment, the counter 33 can be the forward counter K 210 shown and described on pages 156 and 157 of the Digital Logic Handbook 1969 published by Digital Equipment Corporation, Maynard, Massachusetts, and the reducer or scaler 34, 35 can be the programmable divider stage (Programmierbare Teilerstufe) K 211 shown and described on pages 299 and 300 of Das Digital Logik Handbuch (The Digital Logic Handbook) 1970 published by Digital Equipment GmbH, a German subsidiary of the aforementioned Digital Equipment Corporation of Maynard Massachusetts. Furthermore, the rate multiplier K 184 shown and described on pages 150 and 151 of the aforementioned 1969 handbook is suitable for effecting frequency conversion.

The digital connecting members are constructed as AND-gates. A possible connection for the line 28' moreover exists through the branching location 39.

The rotor 11 has been cleaned first before start-up of the spinning process. The feeding of fiber is halted. During initial acceleration or start-up operation of the rotor 11, the pulse processing device initially does not function. The roller 23 of the thread or yarn withdrawing device 22 has been swung downwardly so that the thread 21 can be inserted in direction opposite that of the arrow 43 through the hollow rotor shaft 12 into the rotor 11 during the thread joining or attachment operation.

The fiber feeding device 17 is then set into operation to provide a slow fiber feed until a fiber ring has been formed in the interior of the rotor 11. The instant the thread 21 comes into contact with the fiber ring, the thread joining or attachment operation per se begins which is rendered detectably by a voltage signal generated in a conventional manner. This voltage signal is transmitted to a non-illustrated sensor which effects the engagement of the roller 23 with the thread 21 and the roller 24 as well as setting the pulse processing device 29 in operation.

From this moment on, the feed of the fibers in direction of the arrow 44 and the withdrawal of yarn or thread in direction of the arrow 43 is controlled and regulated in accordance with the initially yet increasing rotary speed of the rotor 11. This occurs in the following manner: A light beam transmitted from the pulse receiver 27 is greatly reflected from the light areas and barely reflected from the dark areas so that the photoelectronic components of the pulse receiver 27 form electrical rectangular or square-wave signals or pulses and transmit them through the line 28 to the counter 33 and to both reducers or scalers 34 and 35. After a selectively adjustable number of counted pulses, the counter 33 issues a control signal, and actually each output is separately adjustable. Both reducers or scalers 34 and 35 can also be adjustable. They issue control signals through the outputs 45 and 46 proportionally to the input frequency to the digital connecting members 36 and 37, respectively.

Since the digital connecting members are AND-gates, the possibility exists through the counter 33 of either suppressing the signals of both reducers 34 and 35 or of transmitting them to the respective control motors M2 and M1.

Only when the counter 33 issues a control signal through the output line 42, can the control signal coming from the output 45 of the reducer 34 reach the control motor M2 through the connecting member 36 and the connecting line 31. The same applies accordingly to the control signal coming from the reducer 35. In the case at hand, the control motors M1 and M2 are step motors, and the control signals electric voltage signals. The rotary motion of the control motors then follow the frequency of the voltage pulses.

It is also conceivable to regulate or control the motors solely through individually adjustable convertors or reducers or scalers. The connection of a counter affords further control possibilities, however, with respect to the start-up, the further course or development and the quantity or volume of the fiber flow, and the start-up and the further course or development of the thread or yarn withdrawal. Advantageous intervention centrally into the variation of the fiber flow and the yarn or thread withdrawal can thereby especially be made. The invention of the instant application also affords a fiber feed, the course or progress of which is programmable.

As aforementioned, the invention is not limited to the aforedescribed and illustrated embodiment alone. Especially, the pulse processing can deviate within wide limits from the given example without changing the basic principle of the invention.

There are claimed:

1. Method of controlling thread joining in a rotor-spinning machine, which comprises rotating the rotor of the spinning machine, introducing a thread to be joined into the rotating spinning-machine rotor, feeding fiber into the rotating rotor so as to form a ring thereof coming into contact with the thread so as to be joined thereto, withdrawing the joined thread from the rotating spinning-machine rotor, detecting the rotary speed of the spinning machine rotor at a given instant, and applying a pulse proportional to the rotary speed of the spinning machine rotor to control digitally a measure of the material being processed in the spinning operation, the pulse being produced contactlessly from parts of the spinning machine revolving at a speed proportional to the rotary speed of the rotor.

2. Method according to claim 1 wherein the pulse is applied to at least one control motor.

3. Method according to claim 1 which comprises processing the pulses into control signals by passing the pulses through digital connecting members, counters and converters.

4. Device for controlling thread joining in a rotor-spinning machine having means for rotating the rotor of the spinning-machine, means for introducing a thread to be joined into the rotating spinning-machine rotor, means for feeding fiber into the rotating rotor so as to form a ring thereof coming into contact with the thread so as to be joined thereto, and means for withdrawing the joined thread from the rotating spinning-machine rotor, comprising means for detecting the rotary speed of the spinning machine rotor at a given instant, pulse generating means for producing pulses with a frequency proportional to the rotary speed of the rotor of the spinning machine, said pulse generating means comprising a pulse transmitter connected to a rotating member of the spinning machine, and a pulse receiver, said rotating member being a part of the spinning machine revolving at a speed proportional to the rotary speed of the rotor of the spinning machine, and means actuable by the pulses for digitally influencing a measure of the material being spun in the spinning operation.

5. Device according to claim 4 wherein said pulse receiver is constructed for contactless pulse reception.

6. Device according to claim 4 wherein said pulse receiver is connected to a thread joining device which is displaceable relative to the spinning stations of the spinning machine, said pulse receiver being displaceable together with said thread joining device.

7. Device according to claim 4 comprising control motor means for controlling fiber feed to the spinning machine, and a pulse processing device connecting said control motor means to said pulse transmitter of said pulse generating means.

8. Device according to claim 4 comprising control motor means for controlling yarn withdrawal from the spinning machine, and a pulse processing device connecting said control motor means to said pulse transmitter of said pulse generating means.

9. Device according to claim 7 wherein said pulse processing device comprises at least one of a counter, a digital connecting member and a converter.

10. Device according to claim 8 wherein said pulse processing device comprises at least one of a counter, a digital connecting member and a converter.

11. Device according to claim 4 including control motor means for controlling a measure of the material being processed in the spinning operation, said control motor means comprising at least one step motor.

* * * * *